US008054197B1

(12) United States Patent
Martin et al.

(10) Patent No.: US 8,054,197 B1
(45) Date of Patent: Nov. 8, 2011

(54) SPEEDOMETER FOR TRAIN CROSSINGS

(76) Inventors: Chris Martin, Georgetown, IN (US); Tammy Martin, Georgetown, IN (US)

( * ) Notice: Subject to any disclaimer, the term of this patent is extended or adjusted under 35 U.S.C. 154(b) by 354 days.

(21) Appl. No.: 12/455,321

(22) Filed: Jun. 1, 2009

Related U.S. Application Data

(60) Provisional application No. 61/130,251, filed on May 30, 2008.

(51) Int. Cl.
*G09F 9/00* (2006.01)
*G08G 1/09* (2006.01)
*B61L 9/00* (2006.01)

(52) U.S. Cl. ..... 340/815.44; 340/901; 340/903; 340/905; 340/936; 246/125; 246/473 R; 246/473.1

(58) Field of Classification Search ..... 340/815.44, 340/905
See application file for complete search history.

(56) References Cited

U.S. PATENT DOCUMENTS 5,864,304 A * 1/1999 Gerszberg et al. ..... 340/903

* cited by examiner

*Primary Examiner* — Donnie Crosland
(74) *Attorney, Agent, or Firm* — Montgomery Patent & Design; Robert C Montgomery; Joseph T. Yaksich

(57) ABSTRACT

An apparatus that indicates the speed of oncoming trains at train crossings comprises a large digital display attached to a drop gate or alternately on a side gate crossing sign for those crossings without a gate. The digital display is surrounded by a large sign indicating the speed of an oncoming train. A speed detection device aimed in either direction on the track to determine train speed. An interface converts the detected speed into a digital display. It is envisioned that motorists knowing the speed of an oncoming train will be less likely to try to beat the train through the crossing.

15 Claims, 8 Drawing Sheets

SPEEDOMETER FOR TRAIN CROSSINGS

RELATED APPLICATIONS

The present invention was first described in and claims the benefit of U.S. Provisional Application No. 61/130,251, filed May 30, 2008, the entire disclosures of which are incorporated herein by reference.

FIELD OF THE INVENTION

The present invention relates generally to railroad crossing alert and safety systems and, more particularly, to an indicator for railroad crossings which indicates the speed of an oncoming train.

BACKGROUND OF THE INVENTION

Automobile accidents are among the leading causes of death in the United States. Many thousands of railroad crossings intersecting with vehicle roadways exist and the importance of providing adequate and reliable information regarding an oncoming train is crucial to protect motorists. Automobiles struck by trains at railroad crossings usually result in higher mortality rates than other vehicular accidents. These accidents are also among the easiest to prevent. Typically, railroad crossing guards are activated via train detectors and serve as an effective means by which to prevent these accidents. Conventional railroad crossing warning systems include a crossbuck, warning bells, flashing lights, and automatic crossing gates. More complicated safety systems also exist from automated warning and access systems to satellite alert systems. These various attempts to provide warning and alert systems to motorists in close proximity to a railroad crossing with an oncoming train can be seen by reference to several U.S. Patents.

U.S. Patent, issued in the name of Shirkey et al., describes a wireless train proximity alert system generally comprising a plurality of transceivers which are in communication with one (1) another that provides a constant warning signal to vehicles approaching a railroad crossing when a train is approaching. U.S. Pat. No. 5,890,682, issued in the name of Welk, describes a railway crossing collision avoidance system generally comprising a signaling device and GPS receiver that alerts a vehicle in the vicinity of a railroad crossing to an approaching train. U.S. Pat. No. 5,954,299, issued in the name of Pace, describes a railroad crossing traffic warning system apparatus and method therefore generally comprising a series of magnetometer sensor probes buried adjacent to a railroad track that provides an alert to a motorist approaching a railroad crossing to the presence of an oncoming train. U.S. Pat. No. 6,179,252, issued in the name of Roop et al., describes an intelligent rail crossing control system and train tracking system generally comprising an internal controller that receives digital information regarding a train such as, direction speed, length, and identity. U.S. Pat. No. 6,241,197, issued in the name of Harland, describes an automated rail way crossing generally comprising a series of sensors that monitors the passage of a train travelling though a railroad crossing. U.S. Pat. No. 6,572,056, issued in the name of Berry et al., describes a method and apparatus for uniform time warning of railroad trains that controls the approach of an oncoming train such that a uniform warning time is ensured.

These systems can be expensive and require regular maintenance to ensure effectiveness. Many railroad crossings in less populated areas have no warning or alert systems at all or simply employ a standard crossbuck. Many motorists still attempt to beat such systems by either driving around the gates or by ignoring the crossing guard indicators. If these motorists simply knew this speed of the oncoming train, they would think twice about trying to "beat" them across the track. However, many motorists are poor judges of speed or may not have an actual view of the train due to limited line of sight position.

While these devices fulfill their respective, particular objectives, each of these references suffers from one (1) or more of the aforementioned disadvantages. Accordingly, the need has arisen for an effective solution to this problem that will help to prevent drivers from taking these risks. The development of the present invention substantially departs from the conventional solutions and in doing so fulfills this need.

SUMMARY OF THE INVENTION

In view of the foregoing references, the inventor recognized the aforementioned inherent problems and observed that there is a need for a simple and practical means to provide information related to speed of an oncoming train to roadway vehicles approaching a railroad crossing to discourage a motorist from attempting to cross before the train arrives and thus, the object of the present invention is to solve the aforementioned disadvantages and provide for this need.

To achieve the above objectives, it is an object of the present invention to provide a speed indication device for approaching trains at railroad crossings that provides a means for displaying the speed of an approaching train on a conventional railroad crossing, thereby preventing motorists from trying to outrun oncoming trains and causing accidents.

Another object of the speed indication device for approaching trains at railroad crossings is to provide a system comprises a digital speed display, a speed warning sign, a control enclosure, a power drop, a speed detection beam, a power supply, a rechargeable battery, a speed detection circuit, a speed detection means, and a digital display driver. The speed warning sign provides various visual indicia to draw the attention of a motorist to the digital speed display which indicates the speed of an approaching train using the appropriate unit of measurement per local requirements. Thus with a conventional pair of crossing lights energized and the speed of an oncoming train displayed upon the digital speed display, motorists would be less likely to attempt to "beat" the train across the railroad crossing. After the train has passed, the system continuously monitors the train track for other trains.

Yet still another object of the speed indication device for approaching trains at railroad crossings is to provide a speed warning sign comprising warning indicia, a speed detection means that projects a speed detection beam, and a digital display that provides visual indication of the speed of an oncoming train approaching the railroad crossing.

Yet still another object of the speed indication device for approaching trains at railroad crossings is to provide a control enclosure comprising a speed detection circuit that receives digital information from the speed detection means, processes the information and transmits an output signal to the digital speed display.

Yet still another object of the speed indication device for approaching trains at railroad crossings is to provide a system that easily attaches to any standard railroad crossing warning post or crossing gate via a plurality of corresponding couplings with associated Yet still another object of the speed indication device for approaching trains at railroad crossings is to provide a method of utilizing the device that provides dangerous train crossings and additional means to alert motorists to the potential dangers of a last second crossing in a manner which is quick, easy, and effective.

Further objects and advantages of the speed indication device for approaching trains at railroad crossings will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 4*b* is a partial cut-away view of a control enclosure 55, according to the preferred embodiment of the present invention;

FIG. 4*c* is a front view of the control enclosure 55 depicting a fastening means to the pole 30, according to the preferred embodiment of the present invention;

DESCRIPTIVE KEY

Figure 1:
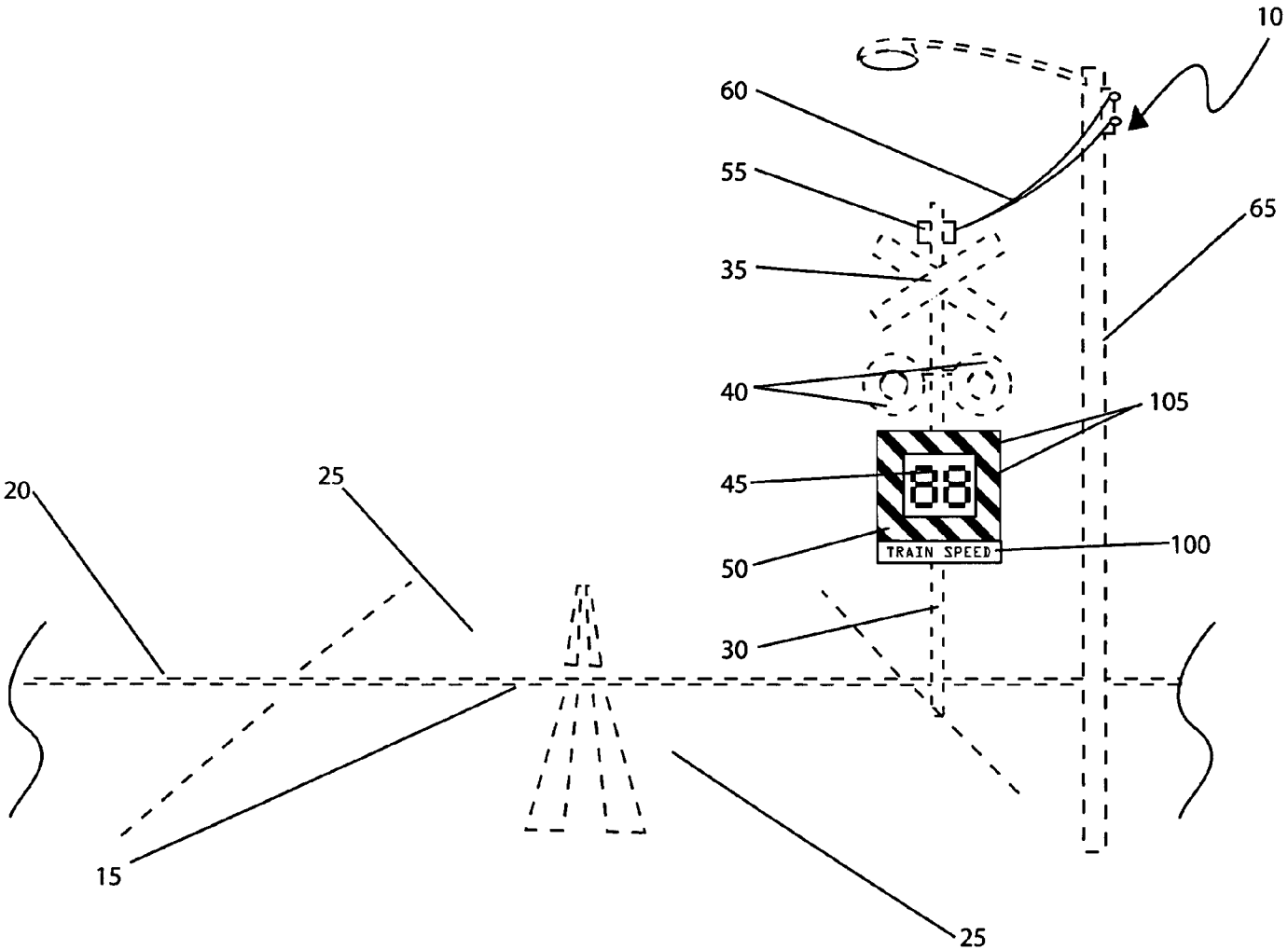
FIG. 1 is an environmental view of the speed indication device for approaching trains at railroad crossings 10, according to the preferred embodiment of the present invention.

10 speed indication device for approaching trains at railroad crossings
15 railroad crossing
20 train track
25 vehicle roadway
30 pole
35 warning sign
40 crossing lights
41*a* fixed coupler
41*b* removable coupler
42 coupler foot
43 coupler fastener
44 nut
45 digital speed display
47 display foot
48 fastener
49 electrical wiring
50 speed warning sign
55 control enclosure
56 control coupler
57 control fastener
60 power drop
65 local utility pole
70 speed detection beam
75 power supply
80 rechargeable battery
85 speed detection circuit
90 speed detection means
95 digital display driver
100 indicia
105 warning indicia
110 guard
115 alternate speed warning sign

DETAILED DESCRIPTION OF THE PREFERRED EMBODIMENT

Figure 4A:
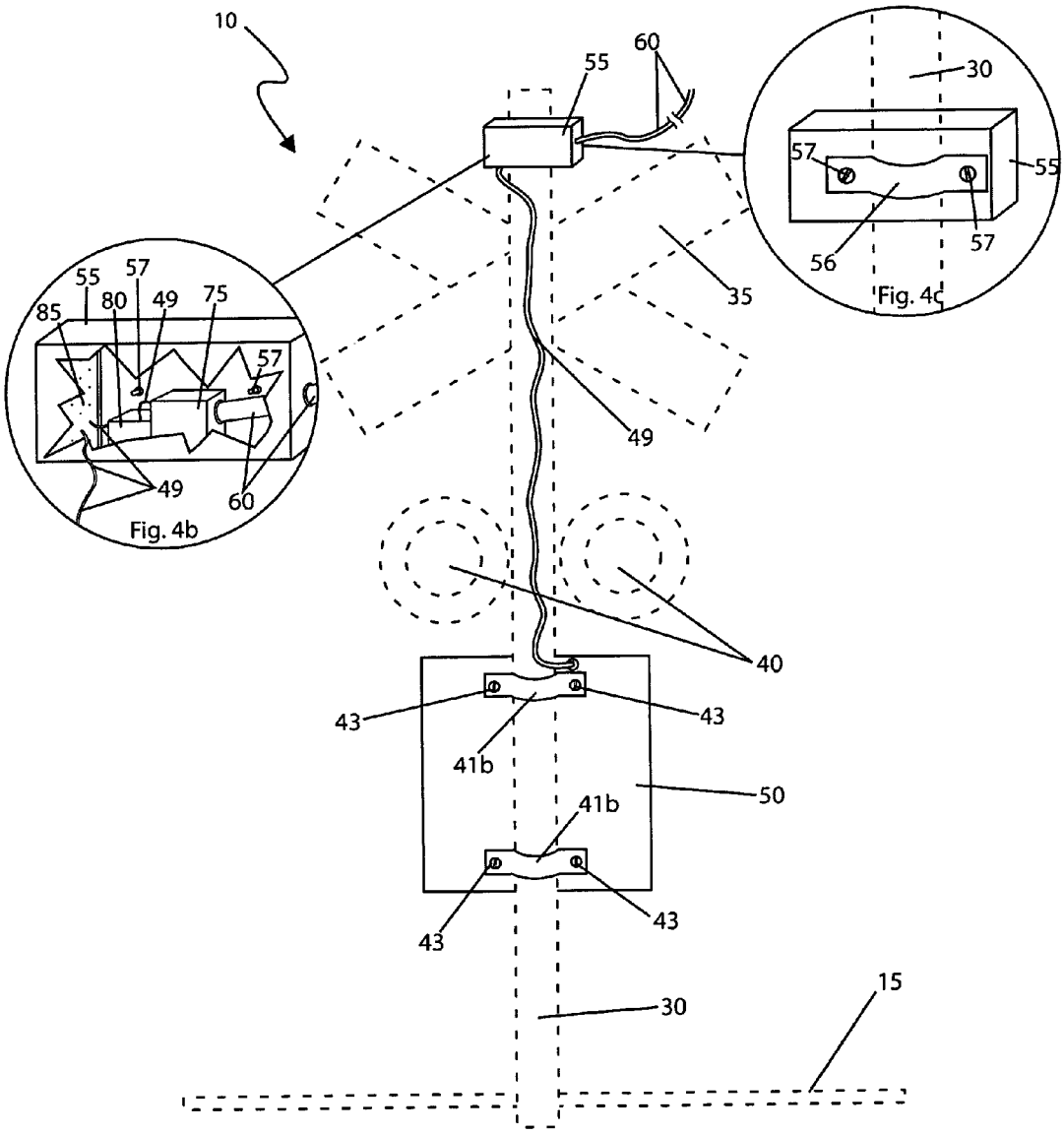
FIG. 4*a* is a rear view of the speed indication device for approaching trains at railroad crossings 10, according to the preferred embodiment of the present invention.
Figure 5:
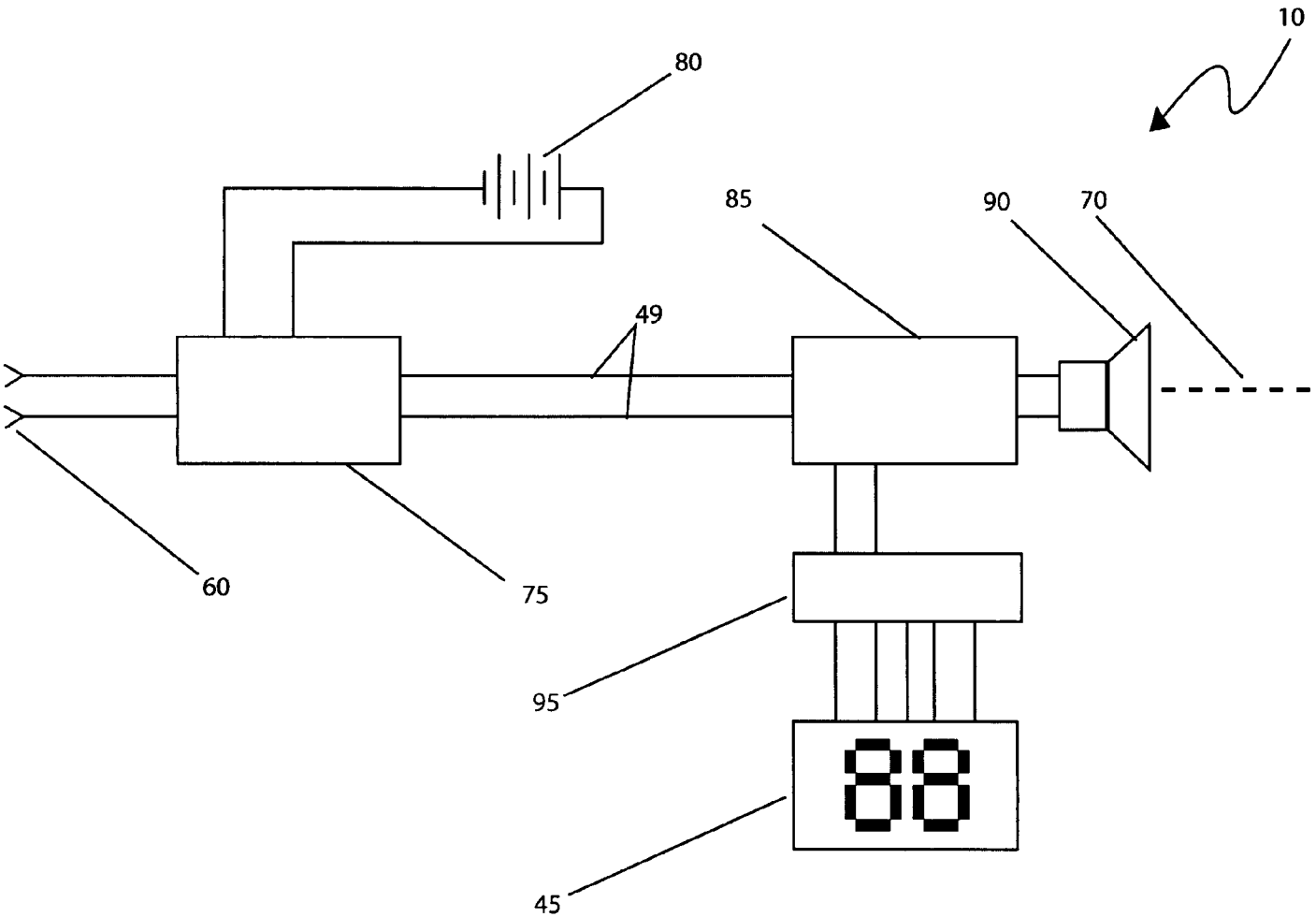
FIG. 5 is an electrical block diagram of the speed indication device for approaching trains at railroad crossings 10, according to the preferred embodiment of the present invention.
Figure 6:
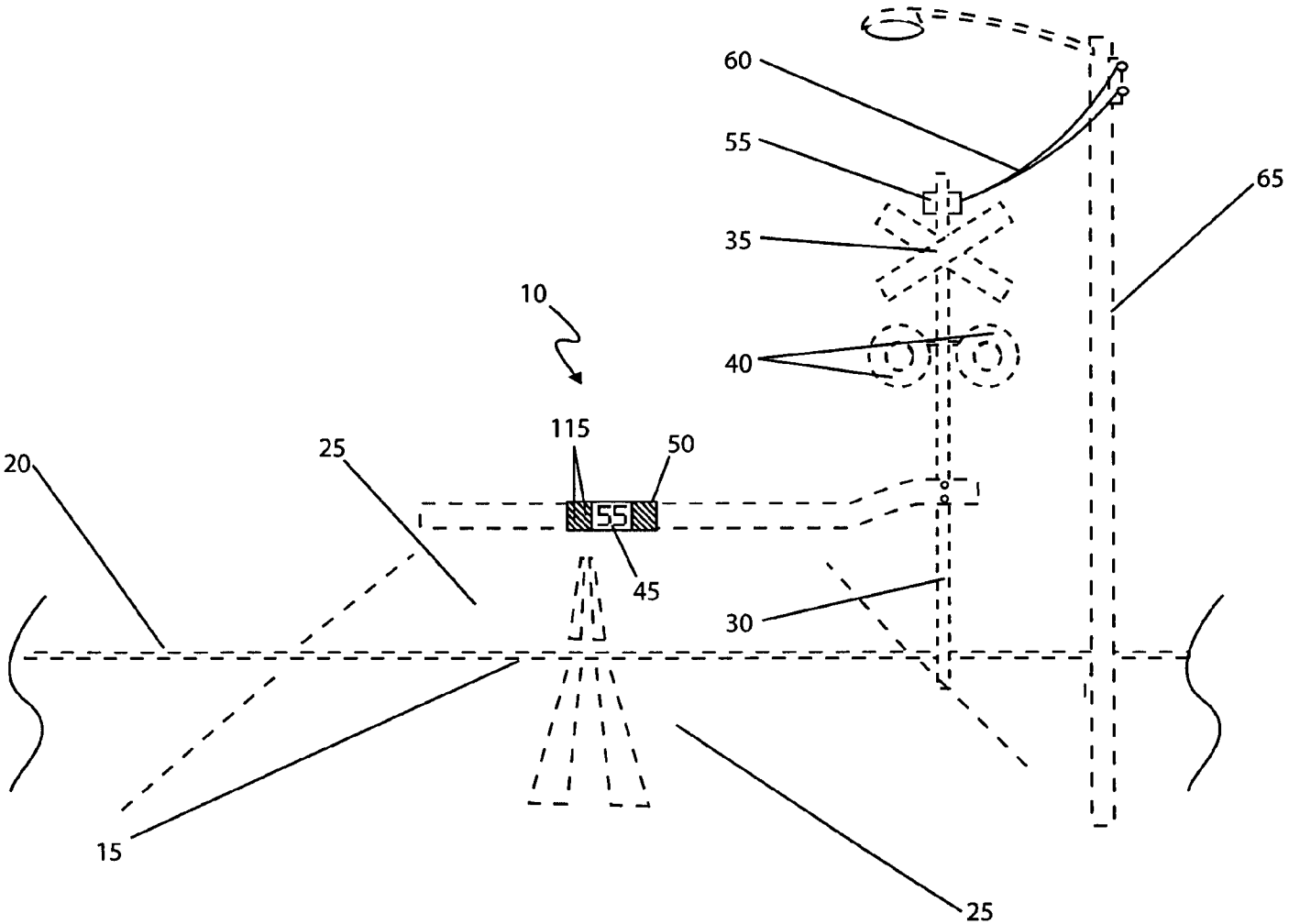
FIG. 6 is an environmental view of the speed indication device for approaching trains at railroad crossings 10, according to an alternate embodiment of the present invention; and, FIG. 7 is a perspective view of the speed indication device for approaching trains at railroad crossings 10, according to an alternate embodiment of the present invention.
Figure 7:
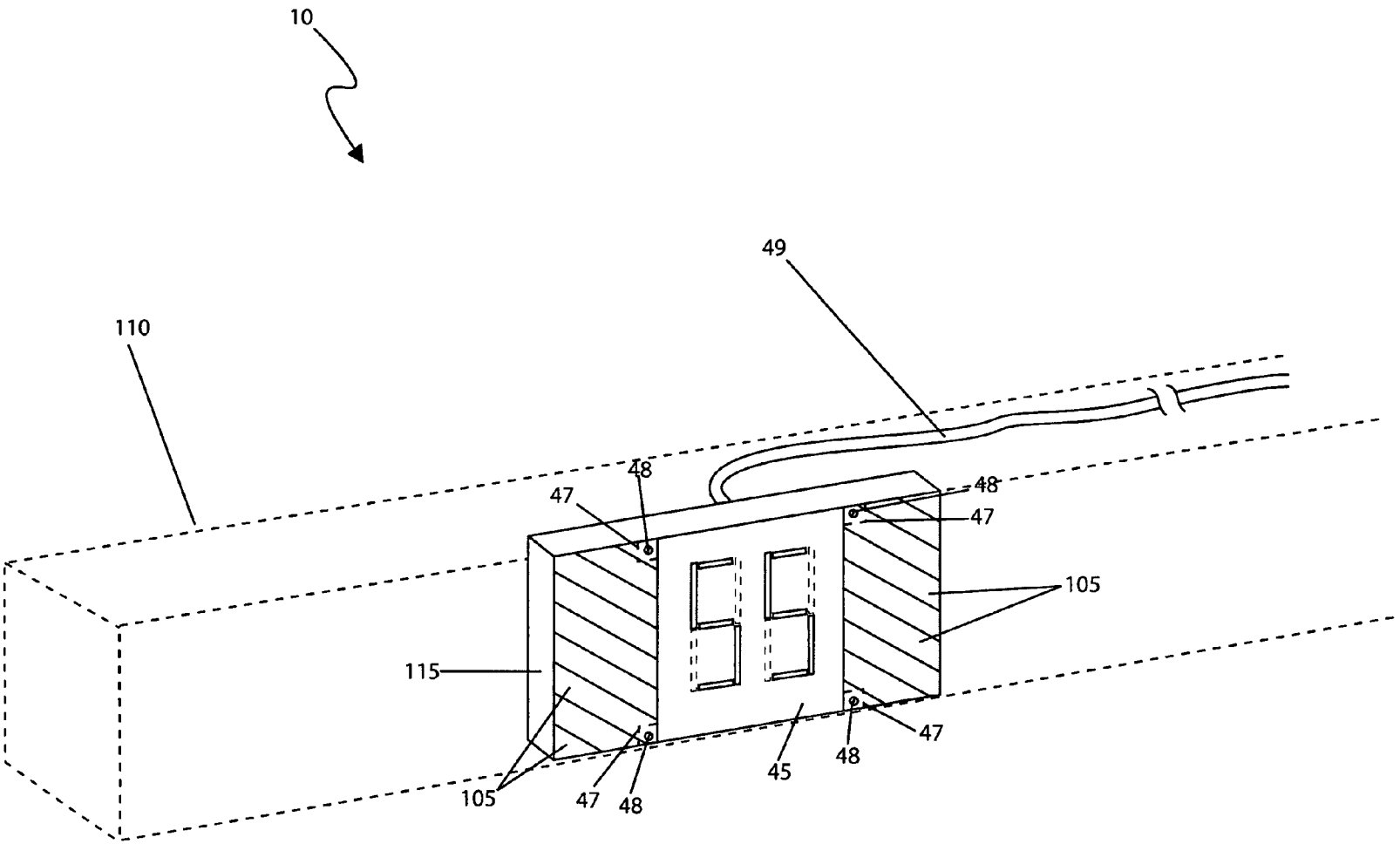

The best mode for carrying out the invention is presented in terms of its preferred embodiment, herein depicted within FIGS. 1 through 5 and alternately within FIGS. 6 and 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a speed indication device for approaching trains at railroad crossings (herein described as the "system") 10, which provides a means for displaying the speed of an approaching train thereon the conventional railroad crossing pole 30, thereby preventing motorists from trying to outrun oncoming trains and causing accidents. Said system 10 comprises a digital speed display 45, a speed warning sign 50, a control enclosure 55, a power drop 60, a speed detection beam 70, a power supply 75, a rechargeable battery 80, a speed detection circuit 85, a speed detection means 90, and a digital display driver 95. The speed warning sign 50 provides all indication of the functionality of the digital speed display 45 and would indicate the speed of an approaching train in the pertinent miles per hour or kilometer per hour as per local requirements. Thus with a conventional pair of crossing lights 40 energized and a speed displayed upon the digital speed display 45, motorists would be less likely to "beat" the train across the railroad crossing 15. After the train has passed, the system 10 continues monitoring the train track 20 for other trains and thus operates in a continuous manner.

Referring now to FIG. 1, an environmental view of the system 10, according to the preferred embodiment of the present invention is disclosed. The system 10 is positioned at a conventional railroad crossing 15 at which a train track 20 would cross a vehicle roadway 25. The railroad crossing 15 is depicted as a standard rural crossing without the use of crossing gate arms. However, the use and functionality of the system 10 will work at any style of railroad crossing 15, and as such, should not be interpreted as limiting factor of the present invention (see FIGS. 6 and 7). A pole 30 provided with the customary warning sign 35 and crossing lights 40 is provided as expected. Additionally, a digital speed display 45 is provided on the pole 30 to indicate the speed of any approaching train. The digital speed display 45 is surrounded by a speed warning sign 50 to indicate the purpose of the digital speed display 45 to any approaching motorists. The various control electronics and speed detection device, whose purpose and functionality will be described in greater detail herein below, are housed in a control enclosure 55, located on the rear of the pole 30. Power for the system 10 is provided by a power drop 60. For purposes of illustration, the power drop 60 is shown as originating from a local utility pole 65 at which electrical power is readily available. However, it should be noted that other sources of power such as solar cell power, underground power, track power commonly used for other warning lights, and other sources of electricity will work equally as well. As such the utilization of the local utility pole 65 should not be interpreted as a limiting factor of the present invention.

Figure 2:
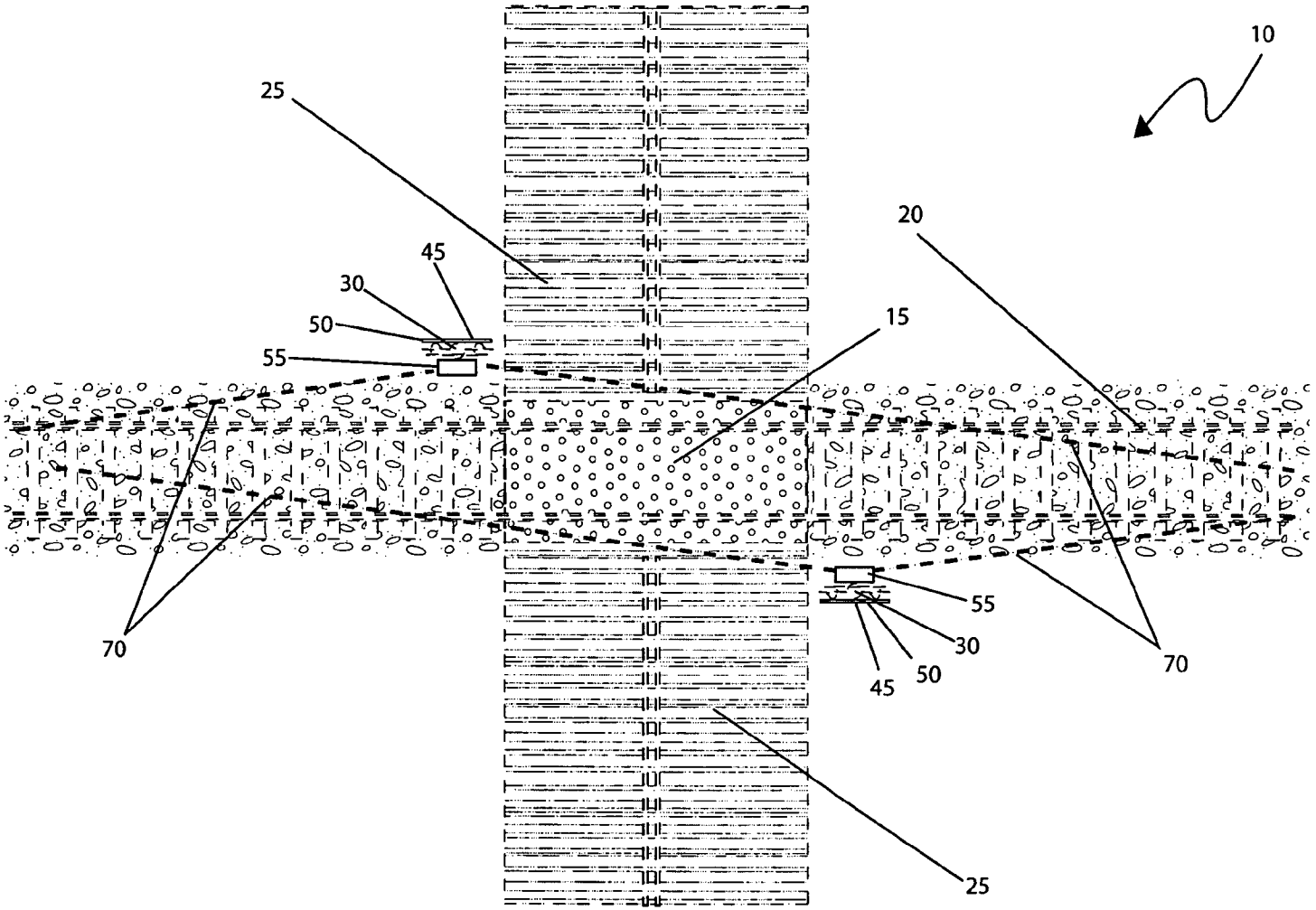
FIG. 2 is a plan view of the speed indication device for approaching trains at railroad crossings 10, according to the preferred embodiment of the present invention.

Referring next to FIG. 2, a plan view of the system 10, according to the preferred embodiment of the present invention is disclosed. This figure more clearly depicts the relationship between the pole 30, the digital speed display 45, and the speed warning sign 50 with regards to the train track 20 and the vehicle roadway 25. It should be noted that the functionally of the system 10 is repeated for each pole 30 located on both sides of the railroad crossing 15 to provide safety features for motor vehicle traffic approaching the railroad crossing 15 from either side of the vehicle roadway 25. However, detailed description of the operation of the system 10 will be provided herein below for purposes of clarity. A speed detection beam 70 emanates from both sides of the speed warning sign 50 as shown and travels in a generally parallel path to the train track 20. This speed detection beam 70 is preferably provided by a laser-based speed detection system, a narrow range microwave speed detection, or other precise means of detecting speed of large objects in a narrow range. The narrow range feature is necessary to allow the system 10 to only calculate speed measurements for objects located on the train track 20 within the length necessary to provide adequate safety warning. Such a feature is also reduces false readings from other objects that may be on or near the train track 20. In the case of dual or multi-track crossings, the speed detection beam 70 would cover all tracks. Should trains be approaching from different directions to the railroad crossing 15, the system 10 will calculate the highest speed and display said speed up on the digital speed display 45.

Figure 3A:
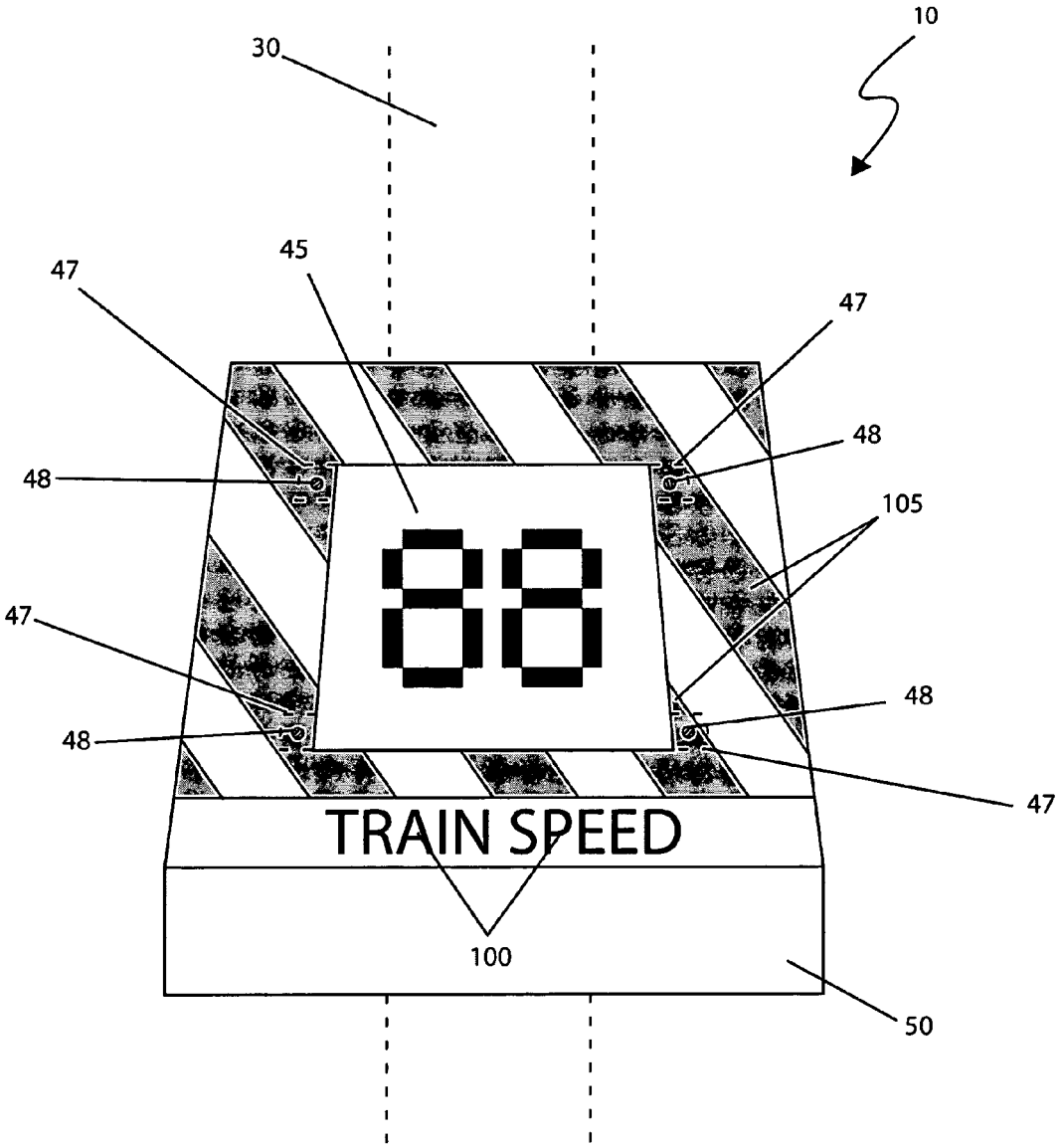
FIG. 3*a* is a front perspective view of the speed indication device for approaching trains at railroad crossings 10, according to the preferred embodiment of the present invention.

Referring now to FIG. 3*a*, a front view of the system 10, according to the preferred embodiment of the present invention is disclosed. Said system 10 comprises a speed warning sign 50 and digital speed display 45 which work in conjunction thereto inform motorists a passing train's speed. The speed warning sign 50 comprises a rectangular body which further comprises conventional warning indicia 105 thereon a front surface. Said warning indicia 105 are preferably conventional diagonally striped lines of an appropriate color which satisfies railroad safety standards. Therebelow said warning indicia 105 is a plurality of indicia 100, thereby communicating to a motorists the purpose of the system 10. The indicia 100 preferably comprises wording such as "TRAIN SPEED", yet other images such as, but not limited to, logos, symbols, pictures, and the like may be utilized to further customize and personalize the system 10. Attached to a center portion of the speed warning sign 50 is the digital speed display 45, thereby providing a numerical reading of the train speed. Said digital speed display 45 is preferably a conventional seven-segment two-digit electronic display measuring an appropriate width and length to be read by motorists. Said digital speed display 45 comprises a plurality of display feet 47, thereby providing an attachment means to an internal portion of the speed warning sign 50 with conventional fasteners 48. The fasteners 48 are positioned through each foot 47 securing the digital speed display 45 to the speed warning sign 50. The digital speed display 50 is fabricated from a durable ultraviolet resistant material such as, but not limited to: plastic, metal, or the like.

Figure 3B:
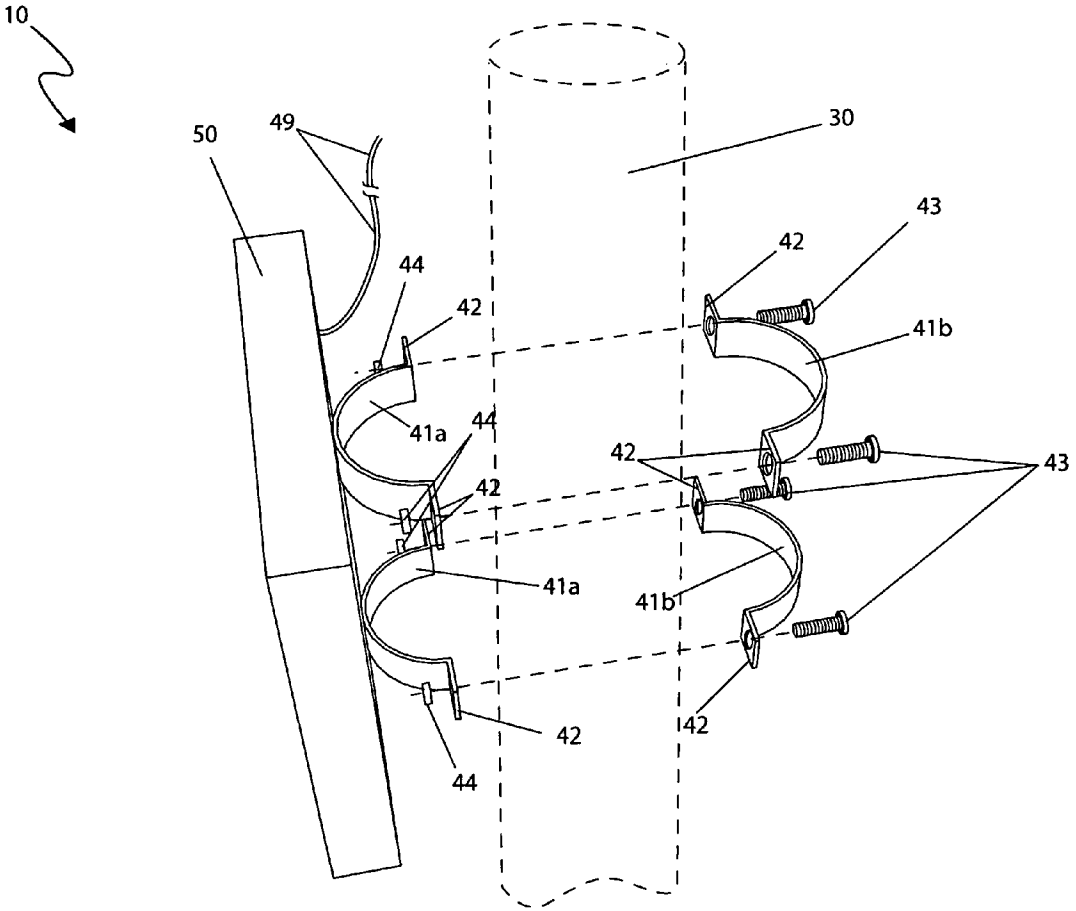
FIG. 3*b* is a rear perspective view of the speed indication device for approaching trains at railroad crossings 10 depicting an attachment means to a pole 30, according to the preferred embodiment of the present invention.

Referring now to FIG. 3*b*, a rear perspective view of the system 10 depicting an attachment means to a pole 30, according to the preferred embodiment of the present invention is disclosed. The speed warning sign 50 is attached to the pole 30 therewith a pair of fixed couplers 41*a*, a pair of removable couplers 41*b*, a plurality of coupler fasteners 43, and a plurality of nuts 44. Each coupler 41*a*, 41*b* takes on an arcuate shape and preferably comprises a pair of coupler feet 42 located on each distal portion. The coupler feet 42 comprise an appropriately sized aperture for insertion of a coupler fastener 43. The coupler fasteners 43 are preferably conventional bolts, yet other similar devices may be incorporated without limiting the functions of the system 10. Each fixed coupler 41*a* is attached in a vertical manner to an intermediate location thereon a rear portion of the speed warning sign 50 and is attached thereto by fastening means such as, but not limited to: welding techniques, plastic mold injection, or the like. The fixed coupler 41*a* and removable coupler 41*b* encompass the pole 30 and the coupler feet 42 thereon the fixed coupler 41*a* engages and aligns with the coupler feet 42 thereon the removable coupler 41*b*. The coupler fasteners 43 are inserted through the apertures on the coupler feet 42 and secured therewith a conventional nut 44. The fixed couplers 41*a*, removable couplers 41*b*, fasteners 43, and nuts 44 are preferably fabricated from a durable material such as, but not limited to: plastic, rust resistant metal, or the like.

Referring now to FIG. 4*a*, a rear view of the system 10 depicting placement thereon a pole 30, FIG. 4*b*, a partial cut-away view of a control enclosure 55, and FIG. 4*c*, a front view of the control enclosure 55 depicting placement thereon the pole 30, according to the preferred embodiment of the present invention are disclosed. The speed warning sign 50 is interconnected to a control enclosure 55, thereby providing a rectangular secure housing to internal electrical components therewith appropriately gauged electrical wiring 49. Said electrical wiring 49 interconnected the digital speed display 45 to a speed detection circuit 85 (also see FIG. 5). The speed detection circuit 85 comprises electrical components such as, but not limited to: a printed circuited board (PBC), microchips, resistors, or the like that which translate the speed of the train from a speed detection beam 70 (see FIG. 5) to the digital speed display 45. The speed detection circuit 85 is also connected to a rechargeable battery 80 and a power supply 75 therewith electrical wiring 49.

The control enclosure 55 is positioned thereon an upper rear portion of the pole 30. Said control enclosure 55 is attached to the pole 30 therewith a control coupler 56 and a pair of control fasteners 57. Said control coupler 56 is a conventional pipe coupler, similar thereto the abovementioned coupler 41, therewith an arcuate body which encompasses the pole 30. A pair of control fasteners 57 engages apertures (not shown) thereon distal portions of the control coupler 56 and is inserted thereinto the control enclosure 55. Said control enclosure 55 is appropriately sized to fit the abovementioned internal electrical components and is preferably fabricated from a durable material similar to the speed warning sign 50.

Referring to FIG. 5, an electrical block diagram which depicts the electrical circuitry as used with the system 10, according to the preferred embodiment of the present invention is disclosed. Electrical power of any suitable voltage or frequency is derived from the power drop 60. An appropriate power supply 75 is then used to regulate and transform the provided power into an acceptable state that can be used by the rest of the electrical components of the system 10. A rechargeable battery 80 would be connected to the power supply 75 to provide short-term emergency operation of the system 10 in instances where the electrical power provided by the power drop 60 would be lost. Resulted in power from the power supply 75 would then be routed to a speed detection circuit 85. The speed detection circuit 85 is of a conventional nature and is well known in the art. As aforementioned described the speed detection circuit 85 would be of a laser-based or narrow beam microwave variety. A conventional speed detection means 90 such as a laser diode or microwave horn assembly, is used to produce and receive the speed detection beam 70 such that it may be used by the speed detection circuit 85 to calculate the speed of an approaching train. The resultant speed signal is passed from the speed detection circuit 85 to a digital display driver 95 for display upon the digital speed display 45. Said digital speed display 45 is a conventional electronic speed display utilized to calm traffic which comprises a plurality of light emitting diodes (LED's) to display a vehicles driving speed.

Referring now to FIG. 6, an environmental view of the system 10 and FIG. 7 a perspective view of the system 10, according to an alternate embodiment of the present invention are disclosed. Alternately, the system 10 may be fabricated to be recessed thereinto a railroad crossing guard 110. The alternate embodiment comprises a rectangular alternate speed warning sign 115 appropriately sized thereto configure to the guard 110 which also comprises warning indicia 105 and a digital speed display 45. The digital speed display 45 is attached to the alternate speed warning sign 115 internally therewith the digital display foot 47 and fastener 48 as above-mentioned. The electrical wiring 49 which interconnects the digital speed display 45 to the control enclosure 55 is routed through the guard 110 and upwardly along the rear portion of the pole 30. The alternate speed warning sign 115 is secured to the guard 110 therewith fastening means such as, but not limited to: bolts, adhesive, or the like. Said alternate speed warning sign 115 is fabricated from similar materials as the preferred embodiment.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: acquiring the system 10; engaging the fixed couplers 41*a* to the pole 30; aligning the removable couplers 41*b* with the fixed coupler 41*a* and inserting a coupler fastener 43 through the aperture and securing with a nut 44; fastening the control enclosure 55 to an upper portion of the pole 30, thereby engaging the control coupler with the pole 30 and securing to said control enclosure 55 with a pair of control fasteners 57; routing electrical wire 49 from the digital speed display 45 to the speed detection circuit therein the control enclosure 55; routing the power drop 60 from the power supply 75 therein the control enclosure 55 to an appropriate power source; positioning the speed detection means 90 to a desired location thereon the train tracks 20; allowing the speed detection beam 70 to relay the train speed from a passing train to the digital speed display 45; and, enabling the system 10 to alert motorists of oncoming train speeds.

Alternately, the method of installing and utilizing the system 10 may be achieved by performing the following steps: acquiring the system 10; inserting and securing the alternate speed warning sign 115 to a guard 110; fastening the control enclosure 55 to an upper portion of the pole 30, thereby engaging the control coupler with the pole 30 and securing to said control enclosure 55 with a pair of control fasteners 57; routing electrical wire 49 through the guard 110 from the digital speed display 45 to the speed detection circuit therein the control enclosure 55; routing the power drop 60 from the power supply 75 therein the control enclosure 55 to an appropriate power source; positioning the speed detection means 90 to a desired location thereon the train tracks 20; allowing the speed detection beam 70 to relay the train speed from a passing train to the digital speed display 45; and, enabling the system 10 to alert motorists of oncoming train speeds.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A train speed indication system for displaying a speed of an approaching train on an existing railroad crossing pole and thereby deterring motorists from outrunning oncoming trains, said train speed indication system comprising:

a digital speed display adapted to be positioned on the pole at which an existing train track crosses an existing vehicle roadway;

a speed warning sign surrounding said digital speed display; and, a control enclosure adapted to be positioned on an upper rear portion of the pole, said control enclosure including a speed detection mechanism generating and transmitting a speed detection beam toward the approaching train and thereby determining a speed of the approaching train;

wherein said control enclosure further includes a speed detection circuit communicatively coupled to said speed detection mechanism and said digital speed display.

2. The train speed indication system of claim 1, further comprising:

a power supply source electrically coupled to said speed detecting mechanism, said power supply source receiving a power drop for regulating and transforming power into an acceptable state for use by said speed detection mechanism; and a rechargeable battery electrically coupled to said power supply source in such a manner that said rechargeable battery provides short-term emergency power to said train speed detection system in instances where electrical power provided by the power drop is lost.

3. The train speed indication system of claim 2, wherein said speed detection beam is adapted to be transmitted along a linear path that is generally parallel path to the train track for detecting a traveling speed on the approaching train.

4. The train speed indication system of claim 2, wherein said speed warning sign comprises:

a rectangular body having warning indicia displayed on a front surface thereof, said warning indicia being formed from diagonally striped lines; and, a plurality of indicia communicating a purpose of said train speed indication system;

wherein said digital speed display is attached to a center portion of said speed warning sign for providing a numerical reading of the train speed.

5. The train speed indication system of claim 4, wherein said digital speed display comprises:

a seven-segment two-digit electronic display; and, a plurality of display feet attached to an internal portion of said speed warning sign.

6. The train speed indication system of claim 5, further comprising:

a pair of fixed couplers;

a pair of removable couplers detachably mated to said fixed couplers; and, a plurality of coupler fasteners mated to said fixed and removable couplers respectively;

wherein each of said fixed and removable couplers have an arcuate shape and coupler feet located on each distal portion thereof respectively.

7. The train speed indication system of claim 6, wherein each of said fixed couplers is attached in a vertical manner to an intermediate location at a rear portion of said speed warning sign;

wherein each of said fixed couplers and said removable couplers are adapted to encompass the pole; and, wherein each said coupler feet of said fixed coupler engages and aligns with a corresponding one of said coupler feet of said removable couplers respectively.

8. A train speed indication system for displaying a speed of an approaching train on an existing railroad crossing pole and thereby deterring motorists from outrunning oncoming trains, said train speed indication system comprising:

a digital speed display adapted to be positioned on the pole at which an existing train track crosses an existing vehicle roadway;

a speed warning sign surrounding said digital speed display; and, a control enclosure adapted to be positioned on an upper rear portion of the pole, said control enclosure including a speed detection mechanism generating and transmitting a speed detection beam toward the approaching train and thereby determining a speed of the approaching train;

wherein said control enclosure further includes a speed detection circuit communicatively coupled to said speed detection mechanism and said digital speed display, said speed detection circuit cooperating with said speed detection speed detection mechanism for displaying the train speed on said digital speed display.

9. The train speed indication system of claim 8, further comprising:

a power supply source electrically coupled to said speed detecting mechanism, said power supply source receiving a power drop for regulating and transforming power into an acceptable state for use by said speed detection mechanism; and, a rechargeable battery electrically coupled to said power supply source in such a manner that said rechargeable battery provides short-term emergency power to said train speed detection system in instances where electrical power provided by the power drop is lost.

10. The train speed indication system of claim 9, wherein said speed detection beam is adapted to be transmitted along a linear path that is generally parallel path to the train track for detecting a traveling speed on the approaching train.

11. The train speed indication system of claim 9, wherein said speed warning sign comprises:

a rectangular body having warning indicia displayed on a front surface thereof, said warning indicia being formed from diagonally striped lines; and, a plurality of indicia communicating a purpose of said train speed indication system;

wherein said digital speed display is attached to a center portion of said speed warning sign for providing a numerical reading of the train speed.

12. The train speed indication system of claim 11, wherein said digital speed display comprises:

a seven-segment two-digit electronic display; and, a plurality of display feet attached to an internal portion of said speed warning sign.

13. The train speed indication system of claim 12, further comprising:

a pair of fixed couplers;

a pair of removable couplers detachably mated to said fixed couplers; and, a plurality of coupler fasteners mated to said fixed and removable couplers respectively;

wherein each of said fixed and removable couplers have an arcuate shape and coupler feet located on each distal portion thereof respectively.

14. The train speed indication system of claim 13, wherein each of said fixed couplers is attached in a vertical manner to an intermediate location at a rear portion of said speed warning sign;

wherein each of said fixed couplers and said removable couplers are adapted to encompass the pole; and, wherein each said coupler feet of said fixed coupler engages and aligns with a corresponding one of said coupler feet of said removable couplers respectively.

15. A method of utilizing a train speed detection system displaying a speed of an approaching train on a conventional railroad crossing pole and thereby preventing motorists from trying to outrun oncoming trains, said method comprising the chronological steps of providing and positioning a digital speed display on the pole at which an existing train track crosses an existing vehicle roadway;

providing and surrounding a speed warning sign about said digital speed display; and, providing and positioning a control enclosure on an upper rear portion of the pole by providing a speed detection mechanism and a speed detection circuit communicatively coupled to said speed detection mechanism and said digital speed display;

wherein said speed detection mechanism generating and transmitting a speed detection beam toward the approaching train and thereby determining a speed of said approaching train; and, wherein said speed detection circuit cooperating with said speed detection mechanism and thereby displaying the train speed on said digital speed display.

* * * * *